US008308261B2

(12) United States Patent
Aruga

(10) Patent No.: US 8,308,261 B2
(45) Date of Patent: Nov. 13, 2012

(54) IMAGE RECORDING APPARATUS AND CONTROLLING METHOD THEREOF

(75) Inventor: Toshinao Aruga, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 369 days.

(21) Appl. No.: 12/780,094

(22) Filed: May 14, 2010

(65) Prior Publication Data

US 2010/0295886 A1 Nov. 25, 2010

(30) Foreign Application Priority Data

May 21, 2009 (JP) ..... 2009-123603

(51) Int. Cl.
*B41J 29/38* (2006.01)

(52) U.S. Cl. ..... 347/13; 347/5; 347/9; 347/12; 347/14; 347/15; 347/16; 347/19; 347/40; 347/42; 347/43

(58) Field of Classification Search ..... None
See application file for complete search history.

(56) References Cited

FOREIGN PATENT DOCUMENTS

JP 2001-328245 A 11/2001
JP 2002-144542 A 5/2002

*Primary Examiner* — Matthew Luu
*Assistant Examiner* — Justin Seo
(74) *Attorney, Agent, or Firm* — Holtz, Holtz, Goodman & Chick, PC

(57) ABSTRACT

An image recording apparatus, in which a line head is configured by arranging a plurality of nozzles, some of which are made to overlap, of short nozzle rows each having a jetting nozzle row arranged in one direction relative to a conveyance direction of a recording medium being conveyed by a conveyance mechanism and which forms records an image by jetting ink from the jetting nozzles onto the recording medium, comprises a conveyance information generating unit which generates conveyance information indicating a conveyance distance of the recording medium, a recording medium detecting unit which detects an edge of the recording medium being conveyed, and a controlling unit which performs a density correction of an image recorded by an overlapping portion of the short nozzle rows on the basis of a detection result of the recording medium detecting unit and the conveyance information obtained from the conveyance information generating unit.

19 Claims, 9 Drawing Sheets

IMAGE RECORDING APPARATUS AND CONTROLLING METHOD THEREOF

CROSS REFERENCE TO RELATED APPLICATIONS

This application is based upon and claims the benefit of priority from the prior Japanese Patent Application No. 2009-123603, filed May 21, 2009, the entire contents of which are incorporated herein by reference.

BACKGROUND OF THE INVENTION

1. Field of the Invention

The present invention relates to an image recording apparatus that comprises a line head including a plurality of jetting nozzles and jets ink onto a recording medium from the plurality of jetting nozzles of the line head, and more particularly, to an image recording apparatus where one line head is formed by arranging a plurality of short recording heads, and to a controlling method thereof.

2. Description of the Related Art

Conventionally, for example, a full-line image recording apparatus of an inkjet type is known as an image recording apparatus that executes a recording process for a recoding medium such as paper or the like on the basis of recording data.

In the full-line image recording apparatus, nozzle rows (recording heads) each of which is formed along a length equal to or more than a width of a recording medium in a direction (main scanning direction) orthogonal to a conveyance direction (sub-scanning direction) of conveying the recording medium and is composed of a plurality of nozzles jetting ink droplets are provided for respective ink colors. The nozzle rows for the respective ink colors are separated at predetermined intervals in the sub-scanning direction and are provided so that the nozzles face the recording medium.

Such an image recording apparatus can execute a recording process onto the entire surface of a recording medium only by relatively moving a recording medium and a line head including nozzle rows in a direction nearly orthogonal to the direction of arranging the nozzles. Accordingly, the full-line image recording apparatus can quickly execute the recording process with simple operations without performing operations such as moving a carriage, intermittently conveying a recording medium, and the like.

In contrast, a line head used in a full-line type has problems of high cost, poor yield, low reliability and the like compared with a short recording head.

Image recording apparatuses that solve these problems include an apparatus having a line head where jetting nozzles are formed by arranging a plurality of short nozzle rows arranged in one direction of arranging nozzles. Such a line head has not only advantages, such as low cost, good yield, high reliability and the like, of a short nozzle row but advantages of a line head.

These image recording apparatuses have a problem in that streak-shaped density unevenness, a white spot and the like are prone to occur because of including the above described line head composed of short nozzle rows, and diverse techniques for decreasing streak-shaped density unevenness, a white spot and the like have been proposed.

For example, Patent Document 1 (Japanese Laid-open Patent Publication No. 2001-328245) discloses an image recording head in which dot diameters are formed to become sequentially smaller by sequentially decreasing nozzle diameters toward an edge, and which reduces density unevenness even if an obliquely proceeding recording medium is printed.

Additionally, for example, Patent Document 2 (Japanese Laid-open Patent Publication No. 2002-144542) discloses an image recording method for arranging adjacent short nozzle rows, part of which is made to overlap. The image recording method according to Patent Document 2 eliminates the need for precisely aligning the short nozzle rows in order to prevent a pitch of recording elements at a joint from becoming unsuitable, and this method can record an image of high quality free from color/density unevenness and the like.

SUMMARY OF THE INVENTION

An image recording apparatus in which a line head is configured by arranging a plurality of nozzles, some of which are made to overlap, of short nozzle rows each having a jetting nozzle row arranged in one direction relative to a conveyance direction of a recording medium being conveyed by a conveyance mechanism and which records an image by jetting ink from the jetting nozzles onto the recording medium, comprises: a conveyance information generating unit which generates conveyance information indicating a conveyance distance of the recording medium; a recording medium detecting unit which detects an edge of the recording medium being conveyed; and a recording data controlling unit which performs a density correction of an image recorded by an overlapping portion of the short nozzle rows on the basis of a detection result of the recording medium detecting unit and the conveyance information obtained from the conveyance information generating unit.

A controlling method for use in the image recording apparatus is a method for controlling image recording performed by an image recording apparatus in which a line head is configured by arranging a plurality of nozzles, some of which are made to overlap, of short nozzle rows each having a jetting nozzle row arranged in one direction relative to a conveyance direction of a recording medium and which records an image by jetting ink from the jetting nozzles onto the recording medium, comprises: detecting an edge of the recording medium being conveyed; and controlling a correction of a density of an image recorded by an overlapping portion of the short nozzle rows on the basis of a detection result of the edge and conveyance information.

DESCRIPTION OF THE PREFERRED EMBODIMENT

An embodiment according to the present invention is described in detail below with reference to the drawings.

In the following description, a conveyance direction of a recording medium is referred to as a Y direction or a sub-scanning direction, and a direction orthogonal to the conveyance direction is referred to as an X direction or a main scanning direction.

A configuration of an image recording apparatus according to the embodiment of the present invention is initially described.

Figure 1:
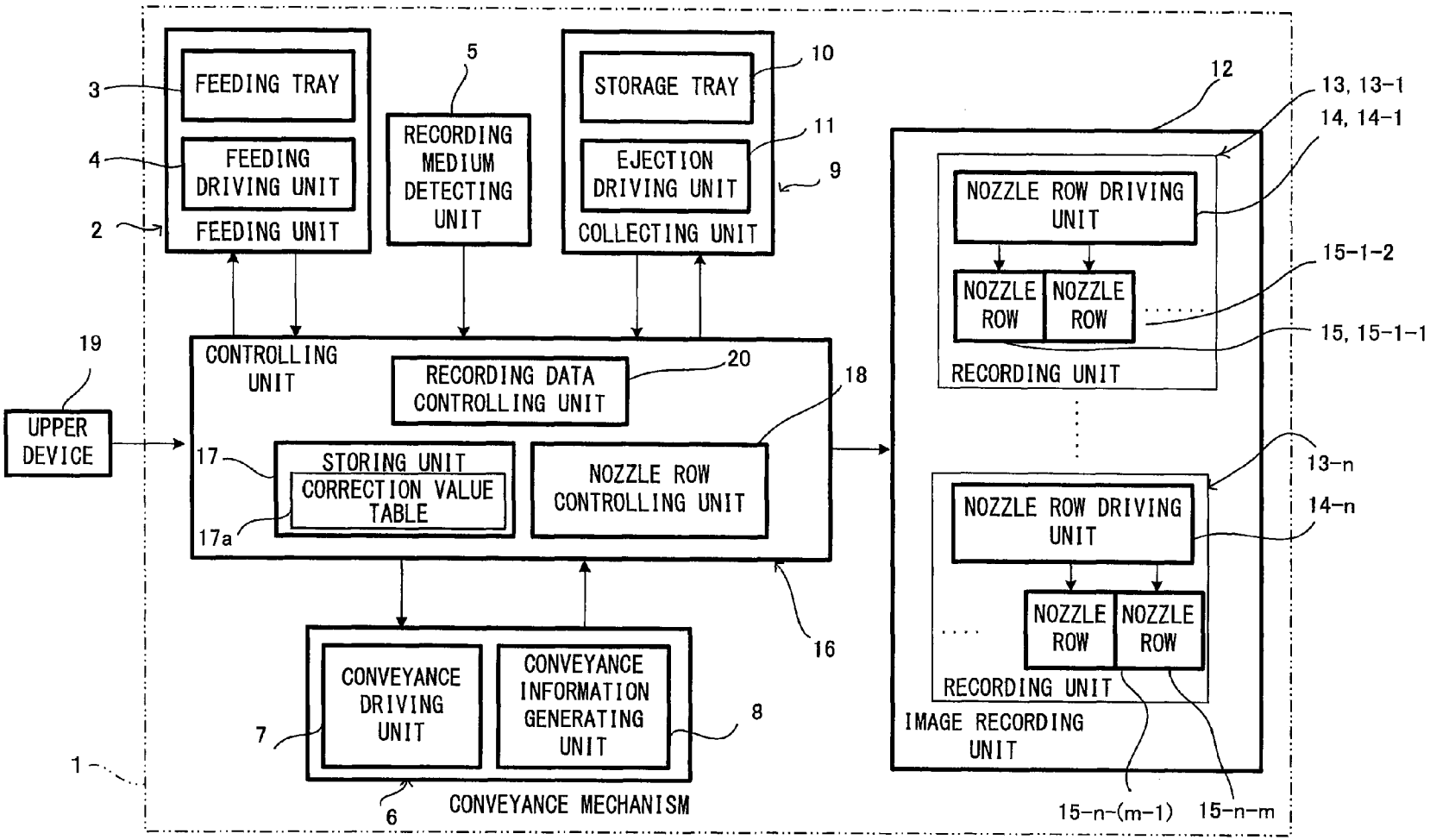
FIG. 1 is a conceptual block diagram illustrating a configuration of an image recording apparatus according to an embodiment.
Figure 2:
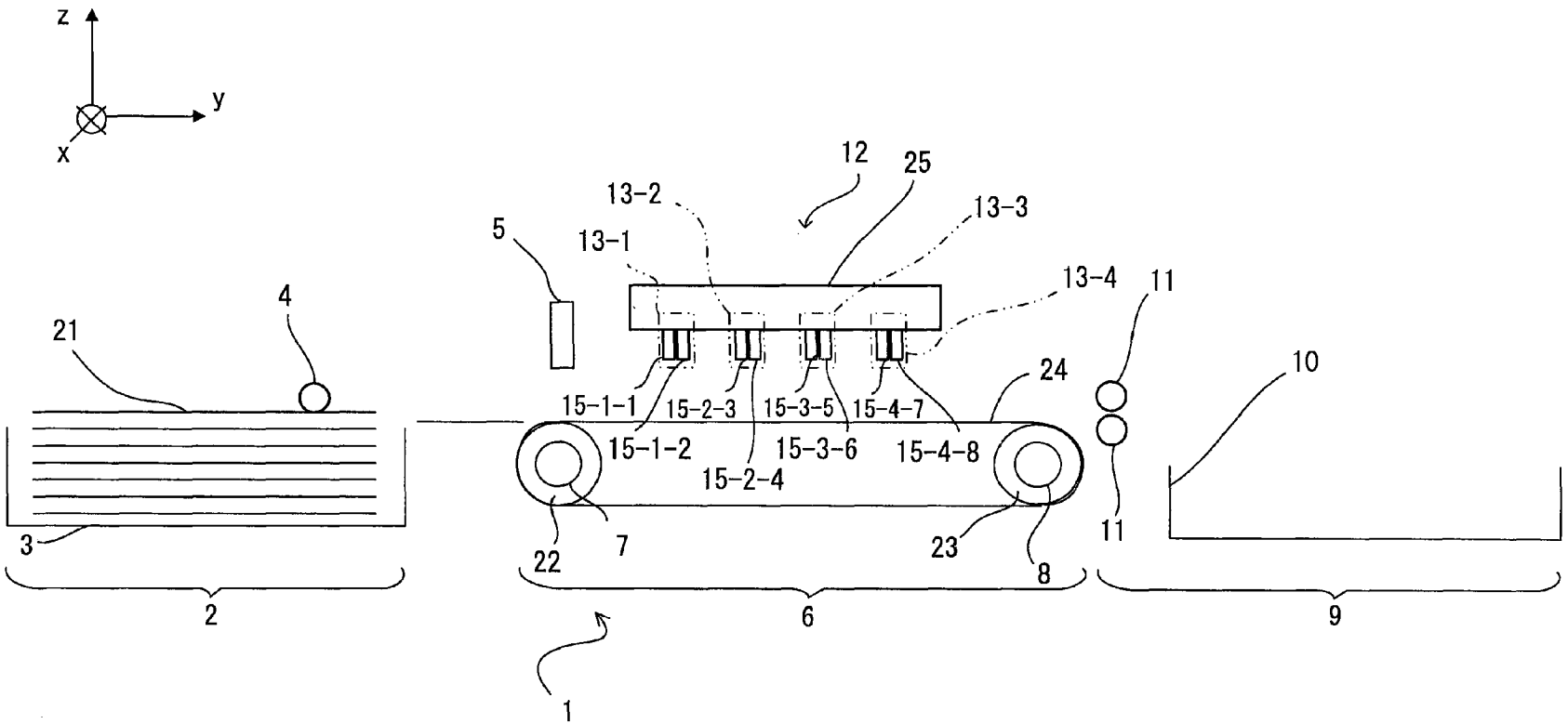
FIG. 2 illustrates an arrangement of components of the image recording apparatus according to the embodiment.

FIG. 1 is a conceptual block diagram illustrating the configuration of the image recording apparatus according to the embodiment. FIG. 2 illustrates an arrangement of components of the image recording apparatus according to the embodiment.

The image recording apparatus 1 according to the embodiment comprises a feeding unit 2, a recording medium detecting unit 5, a conveyance mechanism 6, a collecting unit 9, an image recording unit 12, and a controlling unit 16.

Here, the feeding unit 2 feeds a stored recording medium 21 to a conveyance path. The recording medium detecting unit 5 is provided on a further upstream side than the conveyance mechanism 6 on the conveyance path of the recording medium 21. The recording medium detecting unit 5 detects, for example, a front edge of the recording medium 21. The conveyance mechanism 6 conveys the recording medium 21 passed from the feeding unit 2. The collecting unit 9 ejects and stores the recording medium 21 on which an image is recorded. The image recording unit 12 executes a recording process for recording an image while the recording medium is being conveyed on the conveyance path. The controlling unit 16 controls the entire image recording apparatus 1.

Components of the image recording apparatus 1 are further described next.

The feeding unit 2 comprises a feeding tray 3 and a feeding driving unit 4. Here, the feeding tray 3 stores recording media 21, and is configured with a so-called feeding cassette or the like. The feeding driving unit 4 touches the topmost recording medium 21 stored in the feeding tray 3, picks up the recording media 21 one by one, and passes the recording medium 21 to the side of the conveyance mechanism 6. The feeding driving unit 4 is configured, for example, with a feeding roller. The feeding unit 2 passes the recording medium 21 stored in the feeding tray 3 to the conveyance mechanism 6.

The conveyance mechanism 6 comprises a driving roller 22 and a driven roller 23, which are provided separately in the sub-scanning direction, a conveyance driving unit 7 connected to a rotational axis of the driving roller 22, a conveyance information generating unit 8 connected to a rotational axis of the driven roller 23, and a conveyance belt 24 having no end. Moreover, the conveyance mechanism 6 further comprises at least one absorbing fan not illustrated.

Here, the conveyance belt 24 is provided to be rotatable while making the conveyance surface of the recording medium 21 face ink jetting nozzles of at least one or more recording units 13-1 to 13-n (n is an integer equal to or larger than 2). The recording medium 21 is put on the conveyance belt 24, which conveys the recoding medium 21 at a constant speed. The driving roller 22 is driven by the conveyance driving unit 7, and rotates the conveyance belt 24. The driven roller 23 is rotated by the conveyance belt 24. The conveyance information generating unit 8 is configured by comprising, for example, a rotary encoder. The conveyance information generating unit 8 generates a pulse signal as conveyance information of the recording medium 21 each time the conveyance belt 24 rotates by a predetermined amount, and the conveyance information generating unit 8 outputs the pulse signal to the controlling unit 16. Accordingly, this pulse signal indicates a conveyance distance of the recording medium 21. Moreover, the absorbing fan, not illustrated, generates a negative pressure under the control of the controlling unit 16, and makes the conveyance belt 24 absorb the recording medium 21.

The recording medium detecting unit 5 detects, for example, a front edge and a rear edge of the recording medium 21 in the sub-scanning direction as a front/rear edge position detecting unit. The recording medium detecting unit 5 is configured by comprising, for example, any of an optical transmission sensor, an optical reflection sensor, a capacitive sensor or the like.

The recording medium detecting unit 5 is used as a conveyance direction angle detector for detecting a difference between angles in the conveyance direction of the recording medium 21 and in the main scanning direction. The recording medium detecting unit 5 outputs conveyance direction angle information that is a result of detecting a position of one edge of the recording medium 21 being conveyed in the main scanning direction. The recording medium detecting unit 5 is configured by comprising, for example, a line sensor such as CIS (Contact Image Sensor) or the like as part of the recording medium detecting unit 5. The conveyance direction angle information is used as input information for controlling a nozzle row overlapping portion correction to be described in detail later. Desirably, detection accuracy of the recording medium detecting unit 5 has a degree such that a change in a more precise position than an interval between dots recorded by a nozzle row can be detected.

Here, as the recording medium detecting unit 5, for example, one line sensor is arranged on an upstream side of nozzle rows 15-1-1 to 15-n-m. The line sensor as the recording medium detecting unit 5 detects a position of one edge or positions of both edges of the recording medium 21 being conveyed in the main scanning direction, for example, at a constant conveyance distance interval $\Delta y$. The controlling unit 16 calculates an amount of shift of the edge of the recording medium 21 in the conveyance direction on the basis of a difference $\Delta x$ of the position of the edge of the recording medium 21 in the main scanning direction while being conveyed at the interval $\Delta y$. The controlling unit 16 calculates an angle formed between the conveyance direction of the recording medium 21 and the positions of the nozzle rows 15-1-1- to 15-n-m on the basis of the information detected by the recording medium detecting unit 5.

Additionally, for example, two line sensors are arranged by being separated by the distance $\Delta y$ on the upstream and downstream sides of the nozzle rows 15-1-1 to 15-n-m as the recording medium detecting unit 5, whereby detection accuracy of the angle in the conveyance direction can be improved. In this case, the recording medium detecting unit 5 detects at least the position of one edge of the recording medium 21 being conveyed in the main scanning direction at two points in the conveyance direction. Then, the controlling unit 16 calculates the angle in the conveyance direction of the recording medium 21 on the basis of the difference Δx between the positions detected at the two points and Δy.

Furthermore, if the recording medium detecting unit 5 is configured to detect the positions of both the edges of the recording medium 21 in the main scanning direction, the width of the recording medium 21 being conveyed can be detected as the conveyance direction detection information and the detection accuracy of a position change can be improved. The recording medium detecting unit 5 notifies the controlling unit 16 of the detection information of the front edge, the rear edge, and both the edges of the recording medium 21. The collecting unit 9 is configured by comprising, for example, a storage tray 10 and an ejection driving unit 11. Here, the storage tray 10 stores an ejected recording medium 21. The ejection driving unit 11 ejects the recording medium 21 conveyed by the conveyance mechanism 6. The ejection driving unit 11 is configured, for example, with an ejection roller pair.

The image recording unit 12 comprises at least one or more recording units 13-1 to 13-n. The recording units 13-1 to 13-n comprise the nozzle rows 15-1-1 to 15-n-m (n and m are an integer equal to or larger than 2), and the nozzle row driving units 14-1 to 14-n. The image recording unit 12 is supported by a support member 25.

In the nozzle rows 15-1-1 to 15-n-m, a plurality of nozzles for jetting ink are formed linearly. The nozzle rows 15-1-1 to 15-n-m are provided in the main scanning direction over a length exceeding the maximum width of the recording medium 21 on the basis of a design of the image recording apparatus 1. The nozzle rows 15-1-1 to 15-n-m jet ink droplets from the plurality of nozzles in accordance with a driving signal from the nozzle row driving units 14-1 to 14-n, and execute a recording process for the recording medium 21.

The nozzle row driving units 14-1 to 14-n output a driving signal for driving each nozzle to the nozzle rows 15-1-1 to 15-n-m in accordance with a control signal transmitted from the controlling unit 16 on the basis of recording data information.

The recording units 13-1 to 13-n are configured by arranging the plurality of nozzle rows 15-1-1 to 15-n-m, for example, as illustrated in FIG. 2. FIG. 2 illustrates the case where recording units 13-1 to 13-4, for example, for respective four colors such as K (black), C (cyan), M (magenta), and Y (yellow) are provided. Here, n represents the total number of ink colors. FIG. 2 illustrates the case of n=4. Moreover, m represents the total number of nozzle rows counted regardless of the ink colors. Since two nozzle rows are arranged for per color in FIG. 2, this figure illustrates the case of m=8.

The recording units 13-1 to 13-4 of the respective colors are arranged by being separated in the sub-scanning direction. By respectively driving the nozzle rows 15-1-1 to 15-4-8 at timing corresponding to their positions arranged on the conveyance path, the recording process is executed for the recording medium 21. A travel distance of the recording medium 21 from the position of being detected by the recording medium detecting unit 5 to the position of each of the nozzle rows 15-1-1 to 15-4-8 is generated as conveyance information by the conveyance information generating unit 8. The conveyance information is the number of pulse signals, generated, for example, by a rotary encoder of the conveyance information generating unit 8, according to the conveyance distance of the recording medium 21. By setting the pulse signal, for example, to be generated at an interval of 300 dpi (approximately 85 μm), an arrangement interval between recorded dots can be determined.

The nozzle row driving units 14-1 to 14-n select a nozzle on the basis of recording information transmitted from an upper device 19, and causes the selected nozzle to jet ink by driving the nozzle at timing determined in accordance with an ink jetting timing control signal generated by the nozzle row controlling unit 18 of the controlling unit 16.

The controlling unit 16 respectively controls the feeding unit 2, the conveyance mechanism 6, the collecting unit 9, and the image recording unit 12, and causes them to execute the recording process (image recording) for the recording medium 21.

The controlling unit 16 comprises at least a processing circuit, not illustrated, including an arithmetic processing unit having a control function and a computation function, such as a Micro Processor Unit (MPU), in a storing unit 17, the nozzle row controlling unit 18, and the recording data controlling unit 20. The storing unit 17 stores a control program, and temporarily stores setting values, etc. for the control of the apparatus, and image recording information. The nozzle row controlling unit 18 controls the nozzle rows 15-1-1 to 15-n-m on the basis of the setting values read from the storing unit 17.

The controlling unit 16 controls the components of the image recording apparatus 1 in a way such that the MPU reads and executes the control program from the storing unit 17, and the controlling unit 16 provides a function as the nozzle row controlling unit 18 for controlling ink jetting timings of the nozzle rows 15-1-1 to 15-n-m. The nozzle row controlling unit 18 may be configured not with a software technique for executing the control program but as dedicated hardware with a logic circuit.

The storing unit 17 is configured by comprising a Read Only Memory (ROM) for storing the control program, a Random Access Memory (RAM) serving as a working memory of the MPU, and a nonvolatile memory for storing specification information of the recording process.

The nozzle row controlling unit 18 controls the ink jetting timing on the basis of job information transmitted from the upper device 19, and performs a control for determining a recording position in the sub-scanning direction when the recording process is executed for the recording medium 21.

The recording data controlling unit 20 executes a process for converting image data, received from the upper device 19, into recording data, with which the recording process can be executed, on the basis of the job information and setting values that correspond to the job information and are prestored in the storing unit 17, and the recording data controlling unit 20 transfers the converted data to the image recording unit 12. The image data conversion process executed here includes a data distribution for each nozzle row, data alignment, recording density conversion and the like. Moreover, the recording data controlling unit 20 performs a nozzle row overlapping portion correction control. The nozzle row overlapping portion correction control will be described in detail later.

The upper device 19 is, for example, a computer operated by a user who causes the image recording apparatus 1 according to the embodiment to execute the recording process. The upper device 19 is connected as an external device of the image recording apparatus 1 according to the embodiment, for example, via a Local Area Network (LAN).

The upper device 19 notifies the image recording apparatus 1 according to this embodiment of the job information as information about the recording process. Here, the job information includes image recording information used when the recording process is executed for the recording medium 21. The image recording information includes recording image size information, a resolution, a density and color information of an image for which the recording process is to be executed, and address information of image data stored in a memory of the upper device 19, etc. Moreover, the upper device 19 executes an image data process such as a pseudo graylevel conversion process for converting multi-level image data composed of three primary colors of light such as R (red), G (green), and B (blue) into graylevel values that are composed of K and three primary colors of paints such as C, M and Y and can be output by the image recording apparatus. The upper device 19 transfers the image data to the image recording apparatus 1. Upon receipt of the job information notified from the upper device 19, the controlling unit 16 of the image recording apparatus 1 causes the storing unit 17 to store the job information.

Upon receipt of the job information for instructing the start of the recording process from the upper device 19, the controlling unit 16 controls the conveyance driving unit 7 of the conveyance mechanism to start rotating the conveyance belt 24. Then, the controlling unit 16 controls the feeding driving unit 4 of the feeding unit 2 to pick up recording media 21 within the feeding tray 3 one by one and to pass and convey the recording medium 21 to the conveyance mechanism 6.

For example, the front edge of the recording medium 21 being conveyed on the conveyance path is thereafter detected by the recording medium detecting unit 5. Then, the recording medium detecting unit 5 outputs, to the controlling unit 16, a front edge signal indicating that the front edge of the recording medium 21 being conveyed has been detected. The controlling unit 16 receives the front edge signal, and uses the received signal as a trigger signal for generating the timing of the recording process.

Then, the recording medium 21 that has passed the front/rear edge position detecting unit of the recording medium detecting unit 5 is conveyed to a further downstream side of the conveyance path, is absorbed onto the conveyance belt 24 of the conveyance mechanism 6, and is conveyed.

The controlling unit 16 stores timing information for starting ink jetting by the nozzle rows 15-1-1 to 15-n-m in the storing unit 17. The timing information is a numerical value indicating the number of pulses of the pulse signal of the rotary encoder, which corresponds to a distance, for example, between the position of the front edge notified from the recording medium detecting unit 5 and the positions of the nozzle rows 15-1 to 15-4-8 illustrated in FIG. 2 and is conveyance information generated by the conveyance information generating unit 8.

The controlling unit 16 counts the pulse signal by using the detection signal of the front edge of the recording medium 21 as a trigger. The nozzle row controlling unit 18 of the controlling unit 16 detects a match between the counted number of pulses and a prestored number of pulses of the pulse signal, which corresponds to a distance. Then, the nozzle row controlling unit 18 controls the nozzle row driving units 14-1 to 14-n of the image recording unit 12 at the timing when the match has been detected, and causes the nozzle rows 15-1-1 to 15-4-8 to execute the recording process for the recording medium 21 by jetting ink.

The recording medium 21 for which the recording process has been executed in this way is passed to the collecting unit 9 provided on the downstream side of the conveyance mechanism 6. Then, the recording medium 21 is sandwiched by the ejection driving unit 11, is conveyed to a further downstream side of the conveyance path, and is stored in the storage tray 10.

Figure 3:
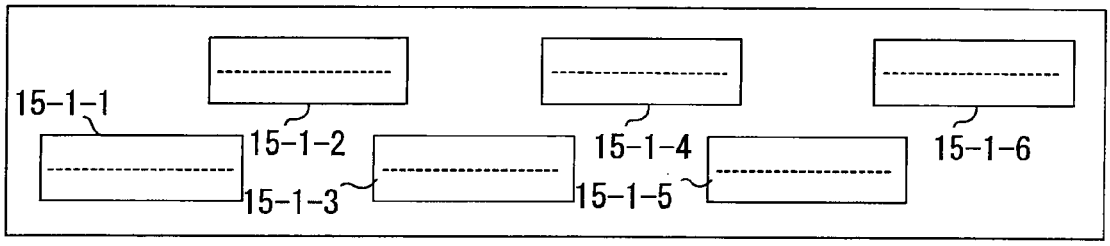
FIG. 3 illustrates one example of a configuration of nozzle rows in the image recording apparatus according to the embodiment.

FIG. 3 illustrates one example of a nozzle row configuration in the image recording apparatus according to this embodiment. In FIG. 3, a line head for recording one color is configured by staggering six nozzle rows, parts of which are made to overlap, in the conveyance direction.

A process, executed by the image recording apparatus 1 according to this embodiment, for correcting an overlapping portion of nozzle rows is described next.

A process for correcting an overlapping portion of nozzle rows is initially described by taking, as an example, a case where the recording medium 21 does not meander.

FIG. 4 is an explanatory view of a basic example of a nozzle row overlapping portion correction in this embodiment when oblique proceeding and meandering of the recording medium 21 are not taken into account.

Figure 4A:
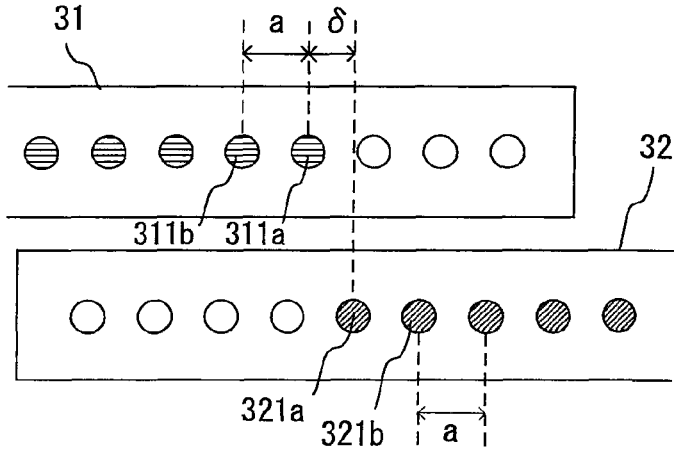
FIGS. 4A to 4D are explanatory views of a basic example of a nozzle row overlapping portion correction performed in the embodiment when oblique proceeding and meandering of a recording medium are not taken into account.

FIG. 4A illustrates an overlapping portion of two short nozzle rows, and ends of the short nozzle rows 31 and 32 that are arranged by making some of their nozzles overlap at a joint.

In FIG. 4A, a nozzle 311*a* and a nozzle 311*b* on the left side thereof in the nozzle row 31 are made to jet ink, whereas a nozzle 321*a* and a nozzle 321*b* on the right side thereof in the nozzle row 32 are made to jet ink. Dots respectively recorded by these nozzles are linked to record an image.

The nozzles of the nozzle rows 31 and 32 are provided at an interval "a". For example, if a resolution is 300 dpi, the interval "a" is approximately 85 μm.

Additionally, the nozzle rows 31 and 32 are arranged so that an interval between the nozzle 311*a* of the nozzle row 31 and the nozzle 321*a* of the nozzle row 32 in the main scanning direction becomes "δ". The nozzle 311*a* of the nozzle row 31 and the nozzle 321*a* of the nozzle row 32 are arranged so that an equation (1) is satisfied, whereby dots are recorded at equal intervals on the recording medium 21.

$$\delta = a \tag{1}$$

For example, if a line head per color is composed of six nozzle rows as illustrated in FIG. 3 and the image recording apparatus 1 supports four ink colors, 24 nozzle rows need to be included. In this case, as many as 24 nozzle rows need to be precisely arranged in order to satisfy the equation (1), and this is very difficult. Accordingly, in the image recording apparatus 1 according to this embodiment, the interval "δ" in FIG. 4A is defined as an equation (2).

$$\delta < a \tag{2}$$

According to the position relationship represented by the equation (2), the image recording apparatus 1 can be implemented by arranging nozzle rows parts of which are made to overlap in the main scanning direction, and by causing the recording data controlling unit 20 to select a range of nozzles used in each nozzle row, without precisely arranging nozzle rows.

Figure 4B:
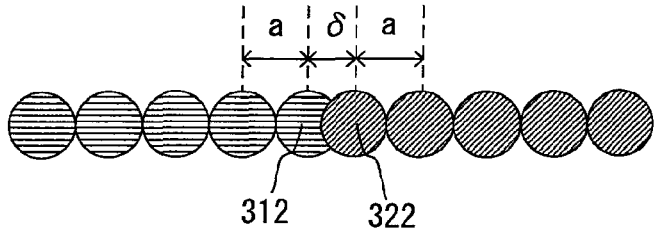

FIG. 4B illustrates positions of dots recorded on the recording medium 21 in a state where a nozzle row overlapping portion correction is not performed in the nozzle row arrangement implemented at the interval "δ" that satisfies the equation (2).

The dot 312 is a dot recorded with ink jetted from the nozzle 311*a* of the nozzle row 31, whereas the dot 322 is a dot recorded with ink jetted from the nozzle 321*a* of the nozzle row 32.

Since FIG. 4B illustrates the dots in the state where the nozzle row overlapping portion correction is not performed, the dots 312 and 322 have the same diameter (area) as the other dots. In this state, since the equation (2) is satisfied, an overlapping portion of the dots 312 and 322 is larger than the other dots, and the image of the overlapping portion is recorded with a higher density than an image recorded by the other dots. As a result, this portion emerges as streak-shaped unevenness of high density in the conveyance direction.

Figure 4C:
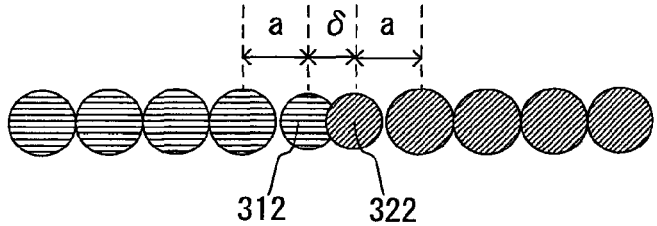

FIG. 4C illustrates an example of the nozzle row overlapping portion correction in a line head of, for example, a multi-drop type, which can adjust the size of a recorded dot with a graylevel output.

The line head of a multi-drop type causes each nozzle thereof to continuously jet very small ink droplets, so that the line head can change a dot diameter (area) in accordance with the number of ink droplets.

In FIG. 4C, dot diameters of the dots 312 and 322 are made smaller than those of the other dots in accordance with the size of the interval "δ". The recording data controlling unit 20 controls dot diameters in this way, whereby an overlap of dots and a gap there are equal in an overlapping portion of the nozzle rows compared with the other portions. As a result, the image density of the image recorded by the dots in the overlapping portion of the nozzle rows becomes equal to that of the image recorded by the other dots, whereby streak-shaped unevenness of high density or a white spot can be prevented from occurring.

A nozzle row overlapping portion correction value used here can be considered as a function of the interval "δ". Moreover, a quantitative value of the nozzle row overlapping portion correction value varies with the degree of blur according to a combination characteristic of ink and the recording medium 21. Therefore, the nozzle row overlapping portion correction value is the function of the interval "δ", and is prestored in the storing unit 17 as a plurality of correction value tables 17*a* in accordance with the type of ink or the recording medium 21. A nozzle row overlapping portion correction value is obtained by referencing the correction value tables 17*a* when an image is recorded, and a dot diameter is controlled on the basis of the nozzle row overlapping portion correction value, whereby a correction can be performed with high precision.

The interval "δ" of each nozzle row overlapping portion is calculated in advance at the time of factory shipment or the initial operation of the image recording apparatus 1, and a nozzle row overlapping portion correction value is stored in association with the interval "δ" in the storing unit 17. Accordingly, when the image recording apparatus 1 executes the image recording process, the recording data controlling unit 20 obtains a nozzle row overlapping portion correction value by referencing the prestored correction value tables 17*a* on the basis of the calculated interval "δ".

The image recording apparatus 1 according to this embodiment may be configured so that the recording data controlling unit 20 directly obtains a nozzle row overlapping portion correction value without prestoring the correction value tables 17*a* in the storing unit 17. In this case, the recording data controlling unit 20 directly obtains a nozzle row overlapping portion correction value on the basis of position information, notified from the recording medium detecting unit 5, of an edge of the recording medium 21 being conveyed and information that is notified from the conveyance information generating unit 8 and indicates the conveyance distance of the recording medium 21.

By making an integer part of the nozzle row overlapping portion correction value correspond to the number of ink droplets and by spreading a decimal part to the next line as an error, a precise correction can be performed.

Figure 4D:
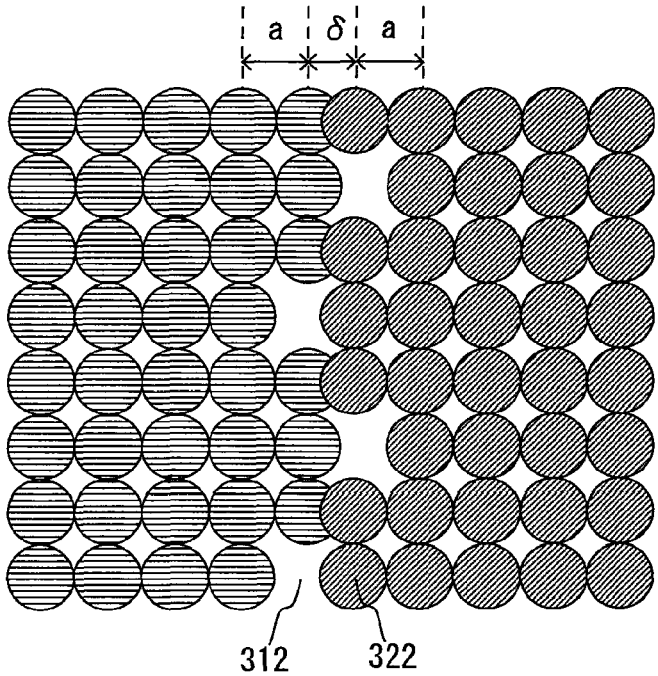

FIG. 4D illustrates an example of a nozzle row overlapping portion correction when the line head is configured as a bilevel output recording head.

The bilevel output recording head can not change a dot diameter. With the bilevel output recording head, by sampling dots every predetermined number of lines, and by macroscopically decreasing the number of dots in accordance with the interval "δ", the image density of an overlapping portion of nozzle rows is made equal to that recorded by the other dots. In this way, the above described dot diameter is adjusted, and at the same time, streak-shaped unevenness of high density and a white spot can be prevented from occurring.

Also for the bilevel output recording head, the nozzle row overlapping portion correction value can be defined as the function of the interval "δ". In this case, a precise correction can be performed by making the integer part of the nozzle row overlapping portion correction value correspond to the presence/absence (1/0) of a dot, and by spreading its decimal part to the next line as an error. This correction value is the function of the interval "δ" similar to the case of FIG. 4, and is prestored in the storing unit 17 as a plurality of correction value tables 17*a* in accordance with the type of ink or the recording medium 21. The recording data controlling unit 20 is configured to obtain the nozzle row overlapping correction value by referencing the correction value tables 17*a* when an image is recorded.

FIG. 5 is an explanatory view of another example of a basic nozzle row overlapping portion correction performed by the image recording apparatus 1 according to this embodiment.

Figure 5A:
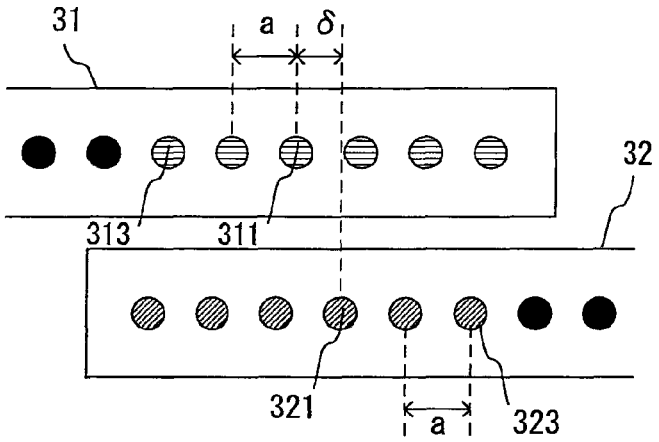
FIGS. 5A to 5D are explanatory views of another example of a basic nozzle row overlapping portion correction performed by the image recording apparatus according to the embodiment.

FIG. 5A illustrates ends of the short nozzle rows 31 and 32 that are arranged by making some of their nozzles overlap at a joint. Also for this arrangement, the interval "δ" satisfies the equation (2). This arrangement is the same as that illustrated in FIG. 4A.

In FIG. 5, an image is recorded by making an image recorded by nozzles on the right side of the nozzle 313 in the nozzle row 31 and an image recorded by nozzles on the left side of the nozzle 323 in the nozzle row 32 overlap.

Figure 5B:
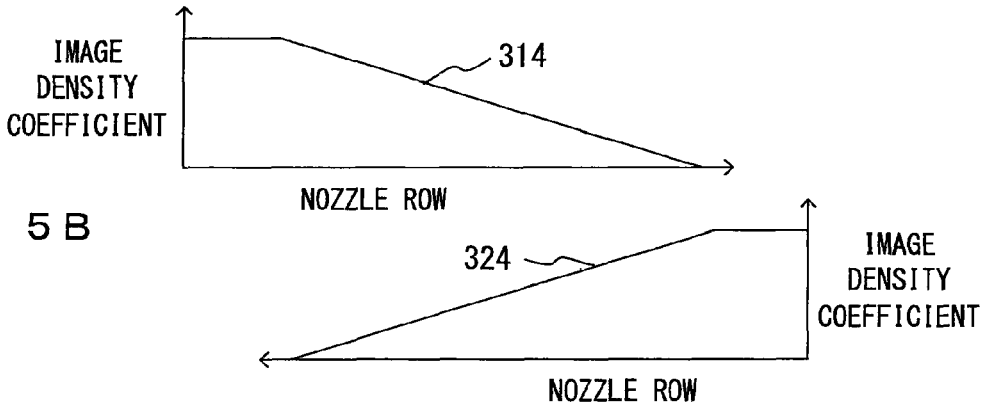

FIG. 5B illustrates an image density coefficient used when ink is jetted from the nozzle rows 31 and 32 of FIG. 5A. In this figure, the horizontal axis represents a position in the main scanning direction, whereas the vertical axis represents an image density coefficient at the position.

An image density coefficient 314 illustrated in FIG. 5B is a density coefficient of the image recorded by the nozzle row 31, whereas an image density coefficient 324 is a density coefficient of the image recorded by the nozzle row 32.

With a correction of a nozzle row overlapping portion illustrated in FIG. 5, an image density recorded by the nozzles on the right side of the nozzle 313 in the nozzle row 31 is gradually decreased toward the end of the nozzle row, and an image density recorded by the nozzles on the left side of the nozzle 323 in the nozzle row 32 is gradually decreased toward the end of the nozzle row. In the area where the image density coefficients are decreased, the image is recorded by making the images respectively recorded by the nozzle rows overlap.

By multiplying image data to be recorded by each of the image density coefficients, a nozzle row overlapping portion correction value of each nozzle is obtained.

Figure 5C:
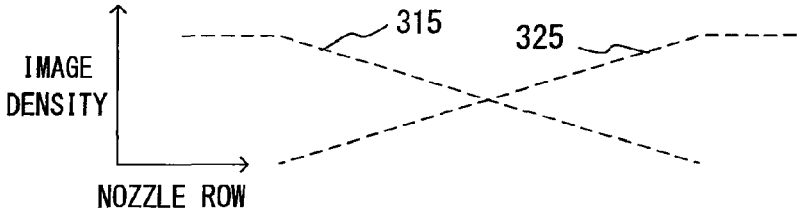

FIG. 5C illustrates the image densities obtained by using the image density coefficients of FIG. 5B. In this figure, the horizontal axis represents a position in the main scanning direction, and the vertical axis represents an image density at the position.

An image density 315 illustrated in FIG. 5C is an image density of the image recorded by the nozzle row 31, whereas an image density 325 is an image density of the image recorded by the nozzle row 32. By obtaining the sum of the image densities 315 and 325, an overlapping portion is corrected to suit an image density in other areas recorded by the nozzle rows 31 and 32.

The image densities 315 and 325 illustrated in FIG. 5C are the image densities of the images respectively recorded by the nozzle rows 31 and 32 when the interval "δ" satisfies the equation (1). In contrast, image densities 316 and 326 illustrated in FIG. 5D are image densities when a correction is performed at the interval "δ" that satisfies the equation (2).

As the interval "δ" decreases, an overlap of dots recorded by the nozzle rows 31 and 32 increases. Therefore, the recording medium 21 that is a base is exposed without being covered by the dots. If an exposed area of the recording medium 21 that is a base increases, an image density generally decreases.

Figure 5D:
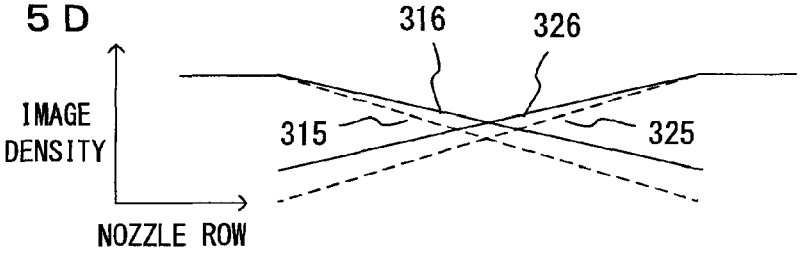

The image densities 316 and 326 illustrated in FIG. 5D are corrected to higher image densities in accordance with a decrease in the image densities.

The nozzle row overlapping portion correction value used for the correction illustrated in FIG. 5D can be defined as the function of the interval "δ". Moreover, the integer part of the nozzle row overlapping portion correction value is made to correspond to the number of ink droplets in the case of a line head of a multi-drop type, or made to correspond to the presence/absence of a dot in the case of a bilevel output recording head. Additionally, the decimal part of the nozzle row overlapping portion correction value is spread to a peripheral image as an error. As a result, a precise correction can be performed. The nozzle row overlapping portion correction value is the function of the interval "δ" similar to the case of FIG. 4, and is prestored in the storing unit 17 as the plurality of correction value tables 17*a* in accordance with the type of ink or the recording medium 21.

A nozzle row overlapping portion correction performed when the recording medium 21, for which the recording process is to be executed, meanders is described next.

FIG. 6 illustrates an interval between nozzles when the conveyance direction of the recording medium 21 and the direction of nozzle rows are changed by oblique proceeding or meandering of the recording medium 21 in this embodiment.

Figure 6A:
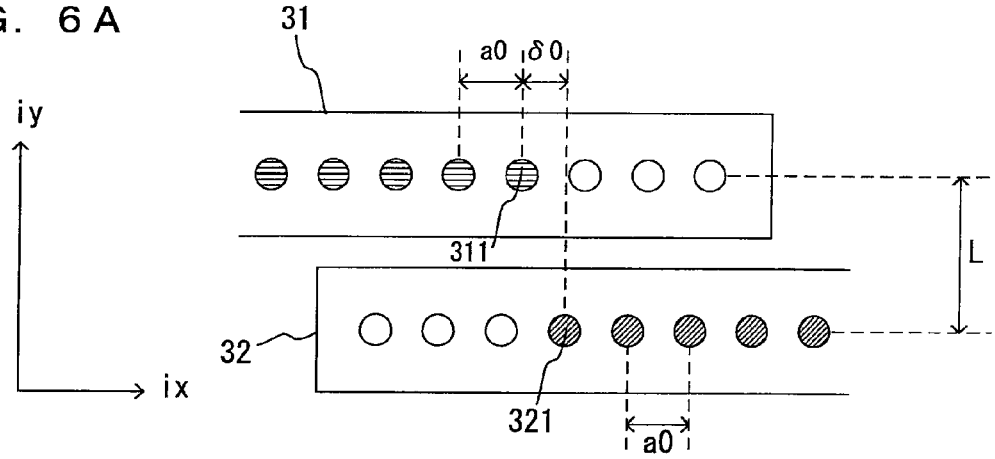
FIGS. 6A to 6C illustrate an interval between nozzles when a conveyance direction of a recording medium and a direction of nozzle rows are changed by oblique proceeding or meandering of the recording medium in this embodiment.

FIG. 6A illustrates an arrangement of the nozzle rows 31 and 32 when the conveyance direction of the recording medium 21 and the direction of nozzle rows are orthogonal to each other. The interval "δ" satisfies the equation (2) in FIG. 6A, and this arrangement is the same as that illustrated in FIG. 4A.

An interval "a0" in FIG. 6A is an interval between nozzles of the nozzle rows 31 and 32, respectively. For example, if the nozzle rows are those having a resolution of 300 dpi, the interval is approximately 85 μm. An interval "L" indicates an interval between the nozzle rows 31 and 32 in the conveyance direction. The interval "L" is, for example, approximately 40 mm.

Figure 6B:
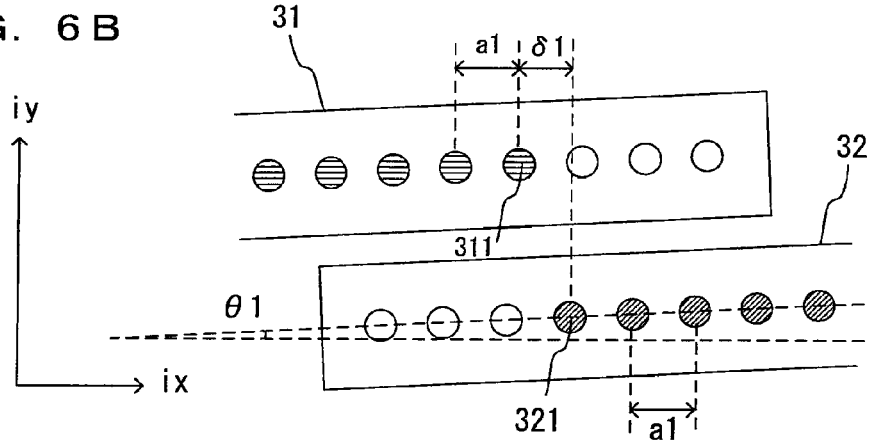

FIG. 6B illustrates a state where the conveyance direction of the recording medium 21 is inclined at an angle θ1 relative to the orthogonal direction of the nozzle rows. In FIG. 6B, the horizontal direction and the vertical direction of an image on the recording medium 21 are respectively referred to as ix and iy in order to represent an influence exerted on an image recorded on the inclined recording medium 21 being conveyed.

The recording medium 21 is inclined, for example, by meandering of the conveyance belt 24. The amount of meandering can periodically change every time the conveyance belt 24 makes a full circle. Alternatively, the amount of meandering can change with time due to the wear-out of the conveyance belt 24, the driving roller 22, the driven roller 23 or the like. In FIG. 6B, assume that the inclination θ1 of the recording medium 21, which is caused by the meandering, is 0.05 degrees and the recording medium 21 proceeds in the ix direction by "L/1000" while being conveyed in the conveyance direction (iy direction) by "L". In this case, an interval "δ1" becomes larger than an interval "δ2" by 40 μm although a difference between intervals "a1" and "a0" is equal to or smaller than 1 μm.

Figure 6C:
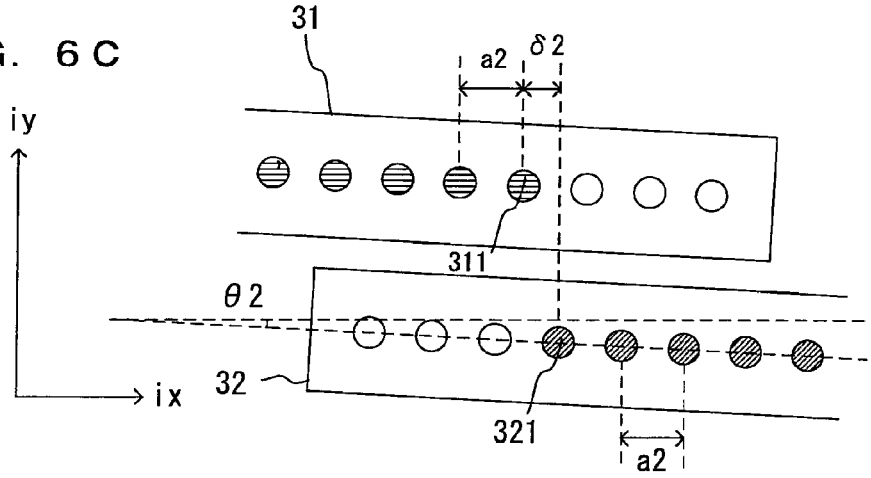

FIG. 6C illustrates a state where the conveyance direction of the recording medium 21 is inclined by θ2 (−θ2) in a direction reverse to θ1. Also assuming that the inclination θ2 is 0.05 degrees and the recording medium 21 proceeds in the ix direction by "L/1000" while being conveyed in the conveyance direction by "L", an interval "δ2" becomes smaller than the interval "δ0" by 40 μm although the difference between the intervals "a1" and "a0" is equal to or smaller than 1 μm.

If the recording medium 21 is conveyed to the recording unit 13 while being inclined by oblique proceeding or meandering, a change in the interval between nozzles in the nozzle rows 31 and 32 in the ix direction is more than a change in an interval between nozzles in the same nozzle row.

A case where a correction is not performed when the recording medium 21 is conveyed to the recording unit 13 while being inclined by the oblique proceeding or meandering of the recording medium 21 is described next.

Figure 7A:
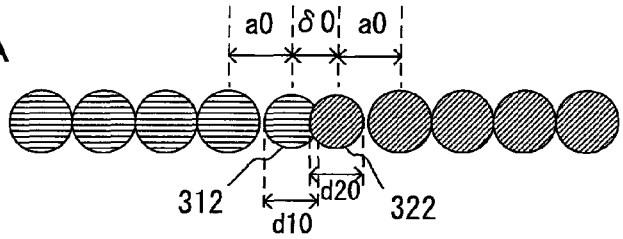
FIGS. 7A to 7C are explanatory views of a case where a correction is not performed when a recording medium is inclined by the oblique proceeding or the meandering of the recording medium and is conveyed to a recording unit.

FIG. 7A illustrates dots recorded by the nozzle rows 31 and 32 when the conveyance direction of the recording medium 21 and the direction of nozzle rows are orthogonal to each other.

In FIG. 7A, the dot 312 is a dot recorded by jetting ink from the nozzle 311 of the nozzle row 31, whereas the dot 32 is a dot recorded by jetting the ink from the nozzle 321 of the nozzle row 32.

The interval "δ0" between the dots 312 and 322 satisfies the equation (2), and the diameters of the dots 312 and 322 are respectively corrected to "d10" and "d20" by performing a nozzle row overlapping portion correction in accordance with the size of the interval "δ0". According to the control performed by the recording data controlling unit 20, streak-shaped unevenness of high density and a white spot are prevented from occurring in a recorded image.

Figure 7B:
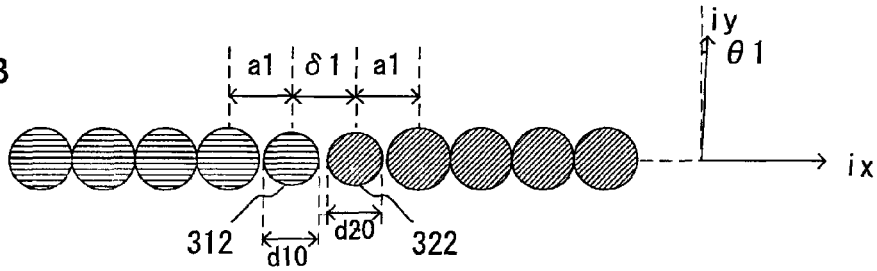

FIG. 7B corresponds to FIG. 6B. This figure illustrates dots recorded by the nozzle rows 31 and 32 in a state where the conveyance direction of the recording medium 21 is inclined by θ1 relative to the orthogonal direction of nozzle rows.

Assuming that θ1 is 0.05 degrees, a difference between the interval "a1" when the recording medium 21 is inclined and the interval "a0" when the recording medium 21 is not inclined is equal to or smaller than 1 μm. Therefore, the inclination of the image is small, and degradation in the quality of an image recorded by a single nozzle is low. In contrast, the interval δ1 between the dots 312 and 322 when the recording medium 21 is inclined by θ1 is larger by 40 μm than the interval δ0 when the recording medium 21 is not inclined, as described with reference to FIG. 6. Therefore, if the diameters of the dots 312 and 322 remain unchanged respectively as d10 and d20, the surface of the recording medium 21 at the joint of dots recorded by the nozzle rows 31 and 32 is exposed without being fully covered by the dots, and a white spot occurs in the recorded image.

Figure 7C:
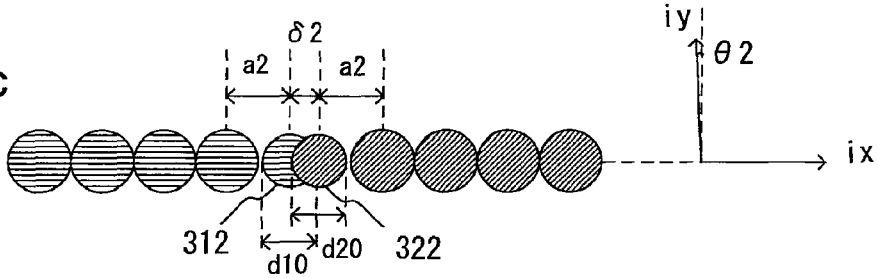

FIG. 7C corresponds to FIG. 6C. FIG. 7C illustrates dots recorded on the recording medium 21 by the nozzle rows 31 and 32 in a state where the conveyance direction of the recording medium 21 is inclined by θ2 (−θ2) in a direction reverse to θ1 relative to the orthogonal direction of the nozzle rows.

Assuming that θ2 is 0.05 degrees, a difference between the interval "a2" when the recording medium 21 is inclined and the interval "a0" when the recording medium 21 is not inclined is equal to or smaller than 1 μm. Therefore, the inclination of the image is small, and degradation in the quality of the image recorded by a single nozzle is small. In contrast, the interval "δ1" between the dots 312 and 322 when the recording medium 21 is include by θ1 is smaller by 40 μm than the interval "δ0" when the recording medium 21 is not inclined, as described with reference to FIG. 6. Accordingly, if the diameters of the dots 312 and 322 remain unchanged respectively as "d10" and "d20", the dots 312 and 322 cause an overlap, leading to streak-shaped unevenness of high density in the recorded image.

If the recording medium 21 obliquely reaches the recording unit 13 due to meandering, oblique proceeding or the like, a white spot or unevenness occurs in an image portion recorded by an overlapping portion of the nozzle rows 15. In contrast, this embodiment prevents the above described streak-shaped unevenness from occurring in a recorded image by changing a correction value with a nozzle row overlapping portion correction when the recording medium 21 is inclined and conveyed in the main scanning direction.

FIG. 8 is an explanatory view of a change in a correction value performed with a nozzle row overlapping portion correction when the recording medium 21 is not conveyed vertically to the main scanning direction due to the oblique proceeding or meandering of the recording medium 21.

Figure 8A:
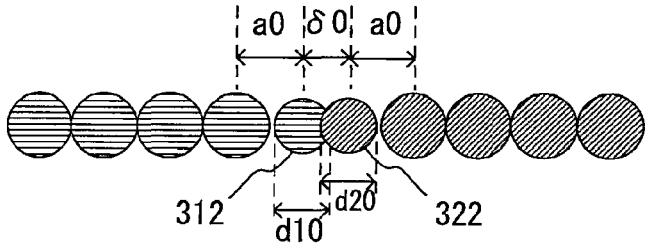
FIGS. 8A to 8C are explanatory views of a change in a correction value, performed with a nozzle row overlapping portion correction, when a recording medium is not conveyed vertically to a main scanning direction due to the oblique proceeding or meandering of the recording medium in the image recording apparatus according to the embodiment.

FIG. 8A illustrates dots recorded by the nozzle rows 31 and 32 when the conveyance direction of the recording medium 21 and the direction of nozzle rows are orthogonal to each other. This figure is the same as FIG. 7A. A value of the interval "δ0" between adjacent head nozzles in a nozzle row overlapping portion is calculated in advance, for example, at the factory shipment or the initial adjustment of the image recording apparatus 1, and the calculated value is prestored in the storing unit 17 as an initial value.

Figure 8B:
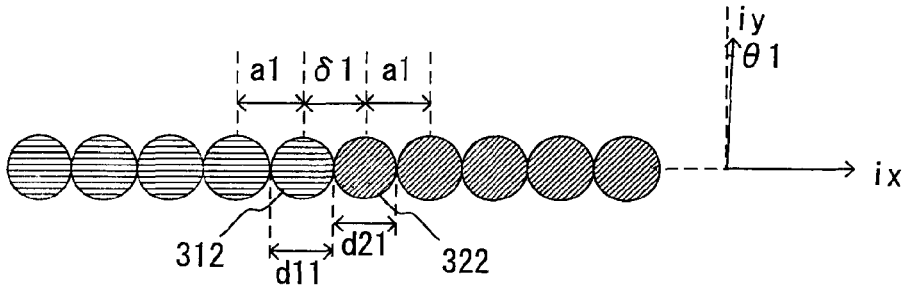

FIG. 8B corresponds to FIGS. 6B and 7B. FIG. 8B illustrates dots recorded by the nozzle rows 31 and 32 in the state where the conveyance direction of the recording medium 21 is inclined by θ1 relative to the orthogonal direction (main scanning direction) of the nozzle rows.

The interval "δ1" illustrated in FIG. 8B is calculated on the basis of the interval "δ0" that the recording data controlling unit 20 prestores in the storing unit 17, and an inclination, namely, a conveyance direction angle calculated on the basis of detection information of the recording medium detecting unit 5. The diameters of the dots 312 and 322 are respectively changed to larger diameters of "d11" and "d21" in accordance with the interval "δ1" increased by the inclination. The controlling unit 16 prestores the amount of change in the dot diameter according to a change in the interval "δ1" in the storing unit 17 as a correction value table 17*a*. When the image recording process is executed, the recording data controlling unit 20 controls a dot diameter by obtaining the amount of change in the dot diameter with reference to the correction value table 17*a* on the basis of the calculated interval "δ1". This prevents a white streak from occurring at the joint of the dots recorded by the nozzle rows 31 and 32 as illustrated in FIG. 7B.

Figure 8C:
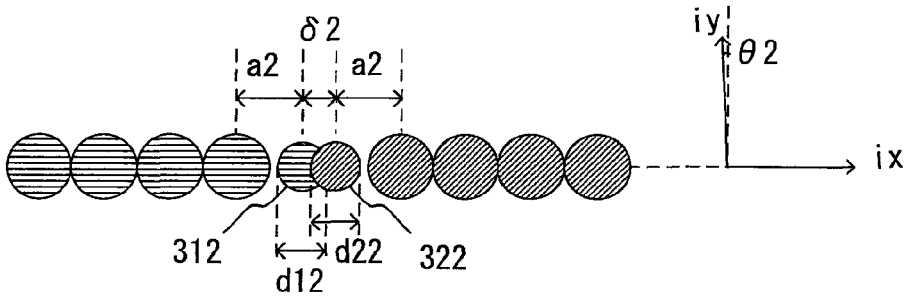

FIG. 8C corresponds to FIGS. 6C and 7C. FIG. 8C illustrates dots recorded by the nozzle rows 31 and 32 in the state where the conveyance direction of the recording medium 21 is inclined by θ2 (−θ2) in a direction reverse to that of FIG. 8B relative to the orthogonal direction of the nozzle rows. Here, the diameters of the dots 312 and 322 are respectively changed to smaller diameters of "d12" and "d22" in accordance with the interval "δ2" reduced by the inclination of the recording medium 21. A quantitative value used for the nozzle row overlapping portion correction can be represented with a function of the interval "δ", and the quantitative value changes with the degree of blur caused by a combination characteristic of ink and the recording medium 21. Accordingly, the quantitative value is prestored in the storing unit 17 as a plurality of correction value tables 17*a* in accordance with the type and the characteristic of ink and/or the recording medium 21 similar to the case where the correction, described with reference to FIGS. 4 and 5, is performed without taking the meandering, the oblique proceeding or the like of the recording medium 21 into account.

The amount of change in a dot diameter in accordance with a change in the interval "δ" is prestored in the storing unit 17 as a correction value table 17*a*. As a result, streak-shaped unevenness of high density at the joint of dots recorded by the nozzle rows 31 and 32 as illustrated in FIG. 7C is prevented from occurring by obtaining a correction value with reference to the correction value table 17*a* when the image recording process is executed, and by correcting the dot diameter on the basis of the correction value. The correction value table 17*a* may be configured to make not an association between the interval "δ" and a nozzle row overlapping portion correction value but an association between the angle θ relative to the orthogonal direction (main scanning direction) of the nozzle rows of the recording medium 21 being conveyed and a nozzle row overlapping portion correction value. In this case, the recording data controlling unit 20 does not calculate the interval "δ", and obtains a nozzle row overlapping potion correction value by referencing the correction value table 17*a* on the basis of the angle θ.

The above description presented with reference to FIGS. 6 to 8 has been provided by using the joint of two nozzle rows. A similar control is performed at joints of all nozzle rows.

Additionally, in FIG. 8, the nozzle row overlapping portion correction performed when the conveyance direction of the recording medium 21 and the direction of nozzle rows change has been described by taking, as an example, a nozzles sequence overlapping portion correction performed by adjusting a dot diameter when the image recording apparatus 1 comprises a line head of, for example, a multi-drop type, which can output a recorded dot with an adjusted graylevel as illustrated in FIG. 4C. The image recording apparatus 1 according to this embodiment, however, is not limited to a configuration including the line head of a multi-drop type. The image recording apparatus 1 may have a configuration including a bilevel output recording head. Moreover, the nozzle row overlapping portion correction performed when the conveyance direction of the recording medium 21 and the direction of nozzle rows change may be a nozzle row overlapping correction using the bilevel output recording head described with reference to FIG. 4D, or the nozzle row overlapping portion correction using the plurality of nozzles as illustrated in FIG. 5 in addition to the correction of changing a dot diameter as described with reference to FIG. 8. Alternatively, the nozzle row overlapping portion correction may be a combination of these corrections.

Figure 9:
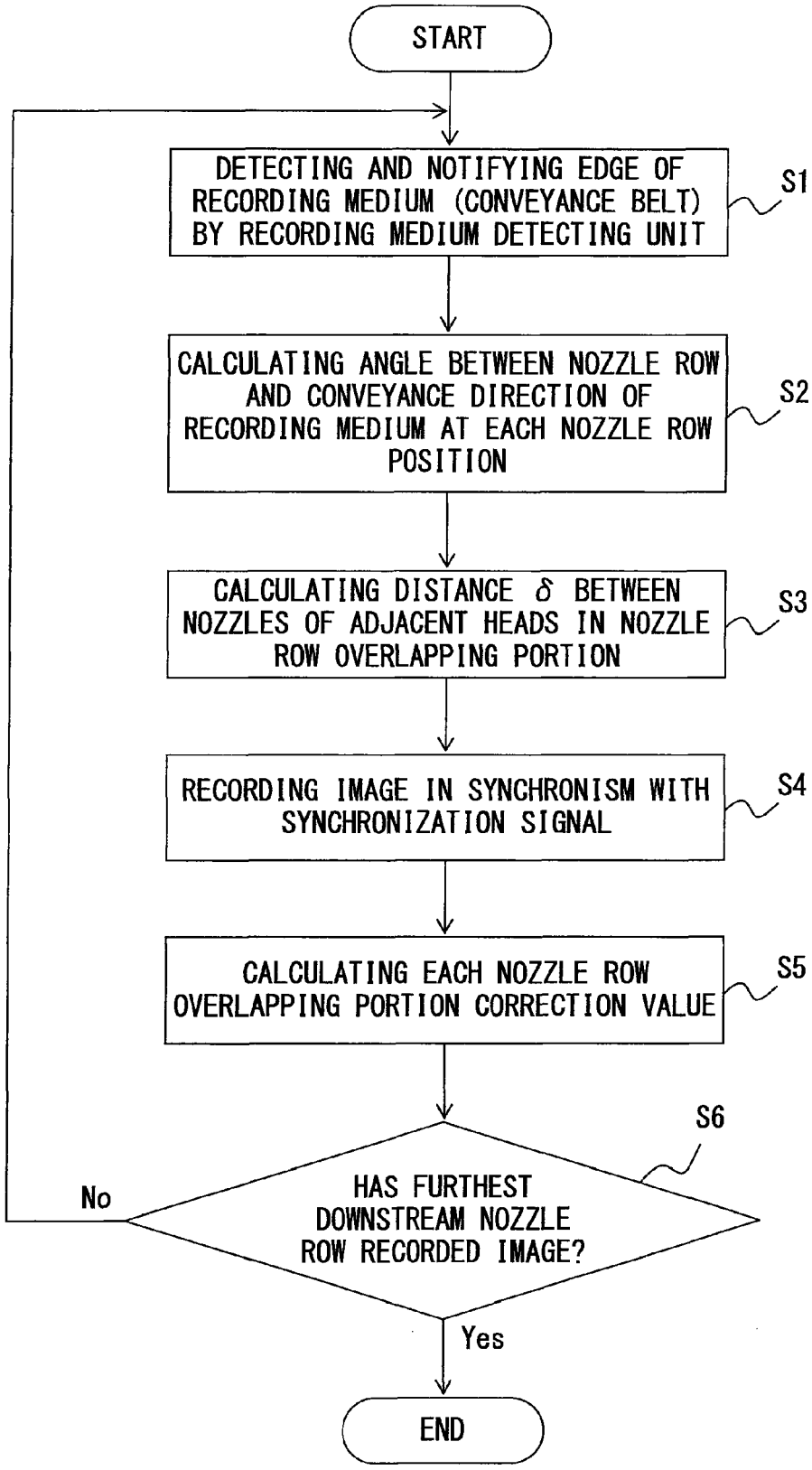
FIG. 9 is a flowchart illustrating a process executed by a controlling unit, a nozzle row controlling unit, and a recording data controlling unit when the image recording apparatus according to the embodiment executes an image recording process.

FIG. 9 is a flowchart illustrating a process executed by the controlling unit 16, the nozzle row controlling unit 18, and the recording data controlling unit 20 when the image recording apparatus 1 according to this embodiment executes the image recording process.

If the process illustrated in FIG. 9 is implemented with a software technique, this process is implemented in a way such that the MPU reads and executes the control program prestored in the nonvolatile memory, not illustrated, of the controlling unit 16.

In step S1, the controlling unit 16 initially detects an edge of the recording medium 21, on which an image is to be recorded, on the basis of a notification transmitted from the recording medium detecting unit 5.

Next, in step S2, the recording data controlling unit 20 calculates an angle formed between the conveyance direction of the recording medium 21 and the nozzle row 15 (main scanning direction) at the positions of the nozzle rows 15-1-1 to 15-n-m on the basis of the detection notification received in step S1.

Then, in step S3, the recording data controlling unit 20 calculates the interval "δ" between adjacent head nozzles in a nozzle row overlapping portion in the main scanning direction on the basis of the angle calculated in step S2 and the interval "δ0", prestored in the storing unit 17, for example, at the time of adjustment made when being produced, between adjacent head nozzles. The interval "δ" may be calculated and obtained with reference to the tables stored in the storing unit 17.

Then, in step S4, the recording data controlling unit 20 calculates each nozzle row overlapping portion correction value on the basis of the interval "δ" respectively calculated in step S3. The nozzle row overlapping portion correction value may be not calculated directly from the angle calculated in step S2 and the interval "δ" but obtained with reference to the correction value tables 17*a* on the basis of the angle calculated in step S2 and the interval "δ". Moreover, the correction value tables 17*a* may be configured not only to make an association between a nozzle overlapping portion correction value, and an angle and the interval "δ" but to make an association between a nozzle overlapping portion correction value and the type of ink and/or the recording medium 21.

Then, in step S5, the recording data controlling unit 20 instructs the nozzle row driving unit 14 to correct the overlapping portion of the nozzle rows 15 on the basis of the nozzle row overlapping portion correction value obtained in step S4 in synchronism with a synchronization signal. The nozzle row controlling unit 18 records an image on the recording medium 21 in accordance with this instruction.

Next, in step S6, the controlling unit 16 determines whether or not the recording process has been executed by the furthest downstream recording unit 13-*n*. If the controlling unit 16 determines that the recording process has not been executed yet by the furthest downstream recording unit 13-*n* ("No" in step S6), the flow goes back to step S1. Then, steps S1 to S6 are repeated. If the controlling unit 16 determines that the recording process has been executed by the furthest downstream recording unit 13-*n* ("Yes" in step S6), this process is terminated.

As described above, with the image recording apparatus 1 according to this embodiment, an image of high quality can be recorded without precisely arranging a plurality of short nozzle rows that configure a line head.

Additionally, the image recording apparatus 1 according to this embodiment can prevent density unevenness or a white spot from occurring even if the recording medium 21, on which an image is to be recorded, is inclined relative to the nozzle rows 15 by meandering, oblique proceeding or the like while being conveyed. As a result, an image of high quality can be recorded.

Furthermore, streak-shaped density unevenness, a white spot and the like can be prevented from occurring even if an angle formed between a recording medium and a nozzle row changes with time or periodically.

What is claimed is:

1. An image recording apparatus in which a line head is configured by arranging a plurality of nozzles, some of which are made to overlap, of short nozzle rows each having a jetting nozzle row arranged in one direction relative to a conveyance direction of a recording medium being conveyed by a conveyance mechanism and which records an image by jetting ink from jetting nozzles onto the recording medium, comprising:

a conveyance information generating unit which generates conveyance information indicating a conveyance distance of the recording medium;

a recording medium detecting unit which detects an edge of the recording medium being conveyed; and a recording data controlling unit which performs a density correction of an image recorded by an overlapping portion of the short nozzle rows on the basis of a detection result of the recording medium detecting unit and the conveyance information obtained from the conveyance information generating unit.

2. The image recording apparatus according to claim 1, wherein the recording data controlling unit obtains an angle θ formed between the conveyance direction of the recording medium and the short nozzle rows on the basis of the detection result of the recording medium detecting unit and the conveyance information obtained from the conveyance information generating unit, and performs the density correction on the basis of a correction value by obtaining the correction value on the basis of the angle θ and an interval δ0 between adjacent nozzles in the overlapping portion of the short nozzle rows.

3. The image recording apparatus according to claim 2, further comprising a storing unit which stores a correction value table that makes an association between the correction value and an interval δ between adjacent nozzles in the overlapping portion of the short nozzle rows in a direction of the nozzle rows when the recording medium is inclined, wherein the recording data controlling unit obtains the interval δ on the basis of the angle θ and the interval δ0, and obtains the correction value by referencing the correction value table on the basis of the interval δ.

4. The image recording apparatus according to claim 3, wherein the interval δ0 is calculated in advance at the time of shipment or an initial operation of the image recording apparatus, and is stored in the storing unit.

5. The image recording apparatus according to claim 3, wherein the correction value table makes an association between the correction value and a characteristic of the recording medium, a characteristic of the ink, and/or the nozzle interval δ.

6. The image recording apparatus according to claim 3, wherein the correction value table makes an association between a density of an image recorded by the overlapping portion of the short nozzle rows and the angle θ.

7. The image recording apparatus according to claim 3, wherein the correction value table makes an association between the angle θ and a dot diameter of the overlapping portion of the short nozzle rows.

8. The image recording apparatus according to claim 3, wherein the correction value table makes an association between the angle θ and a density of a dot of the overlapping portion of the short nozzle rows.

9. The image recording apparatus according to claim 2, further comprising a storing unit which stores a correction value table that makes an association between the angle θ and the correction value, wherein the recording data controlling unit obtains the correction value by referencing the correction value table on the basis of the angle θ.

10. The image recording apparatus according to claim 1, wherein the recording data controlling unit corrects a density of the image recorded by the overlapping portion of the short nozzle rows by controlling a dot diameter.

11. The image recording apparatus according to claim 1, wherein the recording data controlling unit corrects a density of the image recorded by the overlapping portion of the short nozzle rows by controlling a density of a dot of the overlapping portion.

12. The image recording apparatus according to claim 1, wherein the recording data controlling unit corrects a density of the image recorded by the overlapping portion of the short nozzle rows by controlling a density of an image.

13. The image recording apparatus according to claim 1, further comprising a plurality of line heads, wherein the recording data controlling unit is caused to correct the density correction on the basis of the detection result of the recording medium detecting unit and the conveyance information of the conveyance information generating unit when an image is respectively recorded by the plurality of line heads.

14. An image recording apparatus in which a line head is configured by arranging a plurality of nozzles, some of which are made to overlap, of short nozzle rows each having a jetting nozzle row arranged in one direction relative to a conveyance direction of a recording medium being conveyed by a conveyance mechanism and which records an image by jetting ink from jetting nozzles onto the recording medium, comprising:

conveyance information generating means for generating conveyance information indicating a conveyance distance of the recording medium;

recording medium detecting means for detecting an edge of the recording medium being conveyed; and recording data controlling means for performing a density correction of an image recorded by an overlapping portion of the short nozzle rows on the basis of a detection result of the recording medium detecting means and the conveyance information obtained from the conveyance information generating means.

15. A controlling method for image recording performed by an overlapping portion of nozzles in an image recording apparatus in which a line head is configured by arranging a plurality of nozzles, some of which are made to overlap, of short nozzle rows each having a jetting nozzle row arranged in one direction relative to a conveyance direction of a recording medium and which records an image by jetting ink from jetting nozzles onto the recording medium, comprising:

detecting an edge of the recording medium being conveyed; and controlling a correction of a density of an image recorded by an overlapping portion of the short nozzle rows on the basis of a detection result of the edge and a conveyance distance of the recording medium.

16. The controlling method according to claim 15, wherein an angle θ formed between the conveyance direction of the recording medium and the short nozzle rows is obtained on the basis of the detection result of the edge and the conveyance information of the recording medium, a correction value is obtained on the basis of the angle θ and an interval δ0 between nozzles of adjacent nozzle rows in the overlapping portion of the short nozzle rows, and the correction of the density is performed on the basis of the correction value.

17. The controlling method according to claim 16, wherein the correction value is obtained by taking a characteristic of the recording medium and a characteristic of the ink into account.

18. The controlling method according to claim 16, wherein a density of the image recorded by the overlapping portion of the short nozzle rows is corrected by controlling a dot diameter.

19. The controlling method according to claim 16, wherein the density of the image recorded by the overlapping portion of the short nozzle rows is corrected by controlling a density of a dot of the overlapping portion.

* * * * *